US007594336B2

(12) United States Patent
Spaulding

(10) Patent No.: US 7,594,336 B2
(45) Date of Patent: Sep. 29, 2009

(54) LINE ANCHOR

(75) Inventor: James Spaulding, Bristol, CT (US)

(73) Assignee: The Stanley Works, New Britain, CT (US)

( * ) Notice: Subject to any disclaimer, the term of this patent is extended or adjusted under 35 U.S.C. 154(b) by 132 days.

(21) Appl. No.: 11/472,530

(22) Filed: Jun. 22, 2006

(65) Prior Publication Data

US 2007/0294901 A1 Dec. 27, 2007

(51) Int. Cl.
*B43L 7/00* (2006.01)

(52) U.S. Cl. ..... 33/413; 33/1 LE; 33/404

(58) Field of Classification Search ..... 33/413–414, 33/770, 1 LE, 1 G, 1 H, 404–405, 756, 347, 33/370, 409, 758, 521, 566
See application file for complete search history.

(56) References Cited

U.S. PATENT DOCUMENTS

| | | | | |
|---|---|---|---|---|
| 3,113,387 | A | 12/1963 | Bean | |
| 3,122,836 | A * | 3/1964 | Aciego | 33/413 |
| 3,662,471 | A * | 5/1972 | Lynde | 33/770 |
| 4,561,189 | A | 12/1985 | Hirneise | 33/408 |
| 4,697,349 | A | 10/1987 | Lee | 33/27.03 |
| 4,926,562 | A | 5/1990 | Hwu | 33/414 |
| 5,022,158 | A * | 6/1991 | Beyer | 33/413 |
| 5,379,524 | A * | 1/1995 | Dawson | 33/768 |
| 5,704,131 | A | 1/1998 | Courtney | 33/394 |
| 5,720,113 | A | 2/1998 | Bartimus | 33/413 |
| 6,138,370 | A | 10/2000 | Rolfe | 33/407 |
| 6,360,445 | B1 | 3/2002 | Haas | 33/16 |
| 6,370,790 | B1 | 4/2002 | Stenger | 33/758 |
| 6,470,581 | B1 | 10/2002 | Kolodzieski | 33/414 |
| 6,578,274 | B1 * | 6/2003 | Tango et al. | 33/1 G |
| 6,622,393 | B2 | 9/2003 | Bartimus | 33/392 |
| 6,829,836 | B1 * | 12/2004 | Black | 33/369 |
| 6,898,861 | B2 | 5/2005 | Bartimus | 33/392 |
| 6,931,743 | B1 * | 8/2005 | Scarborough | 33/414 |
| 6,964,109 | B1 * | 11/2005 | Bond | 33/414 |

(Continued)

FOREIGN PATENT DOCUMENTS

DE 61539 3/1892

(Continued)

OTHER PUBLICATIONS

Partial European Search Report issued in related European application 07252489.5, Feb. 21, 2008, 4 pages.

*Primary Examiner*—Yaritza Guadalupe-McCall
(74) *Attorney, Agent, or Firm*—Pillsbury Winthrop Shaw Pittman LLP

(57) ABSTRACT

An anchor for securing a line is provided that has an elongated housing with a longitudinal axis, a first end, and a second end. The housing houses an attachment member for securing the anchor to a surface and the attachment member is configured to protrude from the housing and to retract substantially entirely within the housing. An actuation member is received by the housing and has a protruding. The actuation member is operably connected to the attachment member and biased in a direction toward the second end of the housing. The actuation member is further configured to slide axially within the housing and rotate about the longitudinal axis to selectively move the attachment member such that it protrudes from the first end of the housing at any one of a plurality of predetermined distances.

16 Claims, 13 Drawing Sheets

U.S. PATENT DOCUMENTS

| | | | | |
|---|---|---|---|---|
| 7,197,832 | B2 * | 4/2007 | Bond | 33/414 |
| 7,243,433 | B2 * | 7/2007 | Wu | 33/286 |
| 7,260,895 | B2 * | 8/2007 | Long et al. | 33/286 |
| 7,278,218 | B2 * | 10/2007 | Levine | 33/286 |
| 7,409,771 | B2 * | 8/2008 | Bond | 33/409 |
| 7,506,454 | B1 * | 3/2009 | Balliet | 33/414 |
| 2002/0170191 | A1 | 11/2002 | Kolodzieski | 33/414 |
| 2004/0128845 | A1 | 7/2004 | Bartimus | |
| 2008/0282563 | A1 * | 11/2008 | Cruz et al. | 33/414 |
| 2008/0301958 | A1 * | 12/2008 | Darty | 33/409 |

FOREIGN PATENT DOCUMENTS

| | | | |
|---|---|---|---|
| DE | 61539 | C | 3/1892 |
| EP | 1901035 | A2 | 3/2008 |
| EP | 1901035 | A3 | 6/2008 |

* cited by examiner

LINE ANCHOR

FIELD OF THE INVENTION

The present invention relates to anchors for securing a line and, more particularly, to an stickpin-type line anchor with a variable extension distance pin.

BACKGROUND OF THE INVENTION

In the construction industry, methods typically require the attachment of a string to a surface to hold the end in place for applying a line of chalk or for general layout purposes. The industry generally relies on an awl, hook, stickpin, or nail. An end hook is typically used to attach the free end of the chalk reel or line reel string to a surface so that the surface can be marked by snapping a line of chalk or using the string as a straight layout line.

Hook-type attachments require an exposed edge of the surface as an end attaching point. Each of the above-mentioned methods are conventionally employed to anchor the free end of layout strings. Each method, however, has particular drawbacks.

Some stickpins, such as that described in U.S. Pat. No. 6,622,393 B2 to Bartimus, require a tool to adjust pin exposure. In such methods, if the exposure distance of the pin is to be adjusted due to use with different work materials, time-consuming tool adjustment must be made each time the material is changed. Where a specific amount of pin exposure is desired, measuring tools must be used to verify the distance.

Other methods and tools require that a pin be locked at a certain length of exposure. Still others make attachment to some line hooks cumbersome, inconvenient, or impossible. To remove conventional stickpins from a workpiece, a user at times must apply a significant pulling force or have to wiggle the pin back and forth, resulting in further damage to the workpiece. Other tools have multiple parts that can become lost and severely hinder their function.

SUMMARY OF THE INVENTION

In accordance with an embodiment of the present invention, an anchor for securing a line is provided that includes a housing and an attachment member for securing the housing to a surface. The attachment member is configured to extend from and retract into the housing. An actuation member is movable with respect to the housing and is operably connected with the attachment member for moving the attachment member. The actuation member is selectively movable to enable the attachment member to protrude a selected distance from the housing.

In accordance with a further embodiment of the present invention, a line anchor is provided that comprises a housing and an attachment member that projects from the housing. A clip is disposed on the housing and is configured to receive an end member of a line. The clip is movable between a deployed position extending outwardly from the housing for engagement with the end member and a storage position wherein the clip is positioned to provide a more compact configuration to the line anchor.

In accordance with a further embodiment of the present invention, a method is provided for anchoring a line. An actuation member is moved to selectively position an attachment member of an anchor at one of a plurality of predetermined distances from an end of a housing and the attachment member is secured to a surface. The end of a line is secured to the housing.

In accordance with a further embodiment of the present invention, a line anchor is provided that comprises an elongated housing having a longitudinal axis and an attachment member that projects from an end of the housing. A protrusion extends from the end of the housing and has a lower surface forming an angle with respect to the longitudinal axis. The protrusion provides leverage for removing the attachment member from a surface.

In accordance with a further embodiment of the present invention, a combination chalk line and anchor is provided that comprises a chalk line having a housing for containing powdered chalk, a line for receiving the chalk, and a hook at the end of the line. The combination further comprises an anchor that has a housing and an attachment member that projects from the housing. A clip secures the anchor to the chalk line. The clip is formed from a resilient metal material and has a portion thereof with a generally U-shaped configuration adapted to receive the anchor. The clip also has projections that are received in openings formed in the chalk line housing.

BRIEF DESCRIPTION OF THE DRAWINGS

The above-mentioned and other features and advantages of the present invention, and the manner of attaining them, will become more apparent and the disclosure itself will be better understood by reference to the following description taken in conjunction with the accompanying drawings, wherein.

Figure 1:
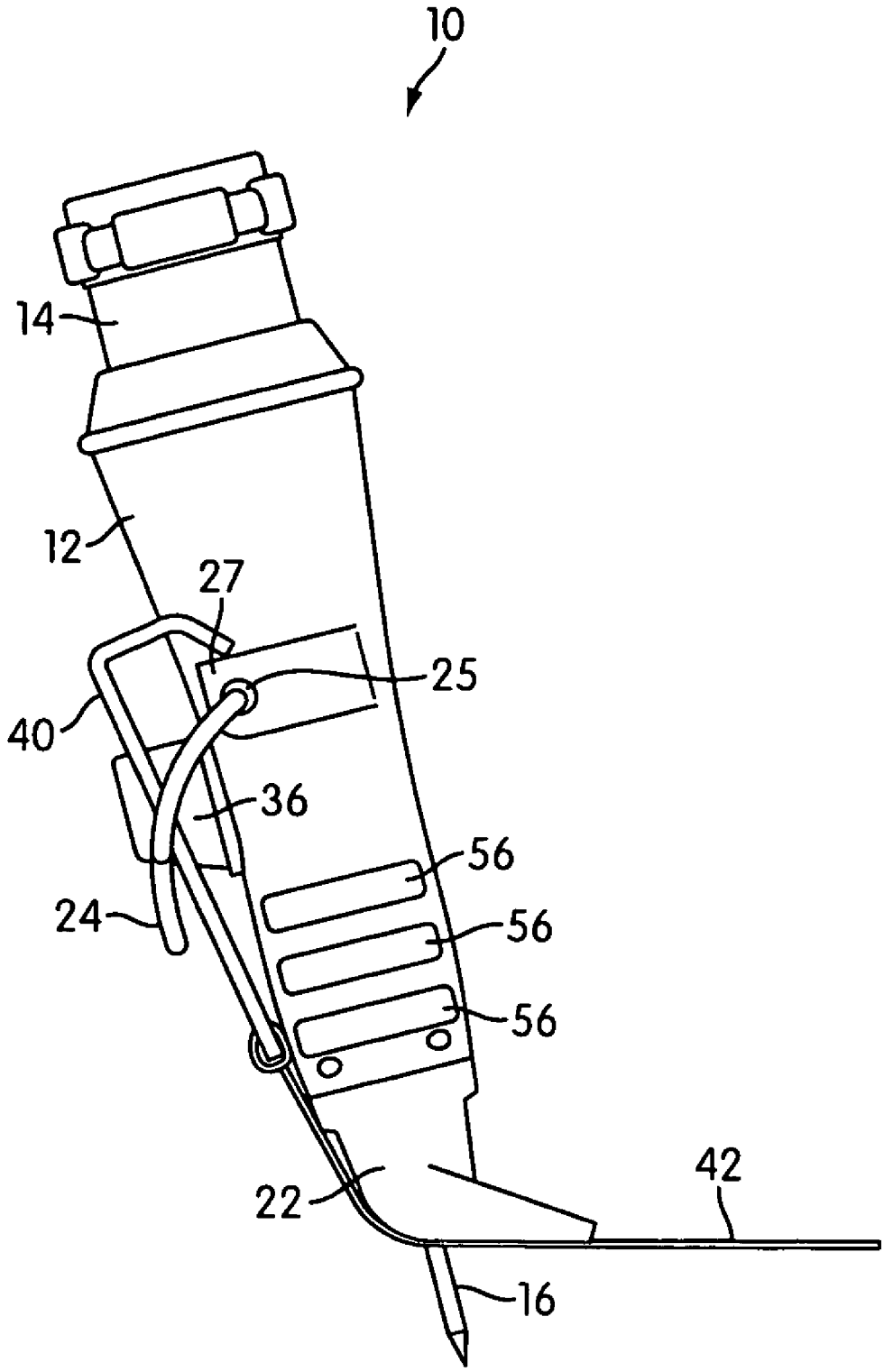
FIG. 1 is a perspective view of a line anchor during use in accordance with an embodiment of the present invention.

The present invention will be described with reference to the accompanying drawings. Corresponding reference characters indicate corresponding parts throughout the several views. The description as set out herein illustrates an arrangement of the invention and is not to be construed as limiting the scope of the disclosure in any manner.

DETAILED DESCRIPTION OF THE INVENTION

Figure 2:
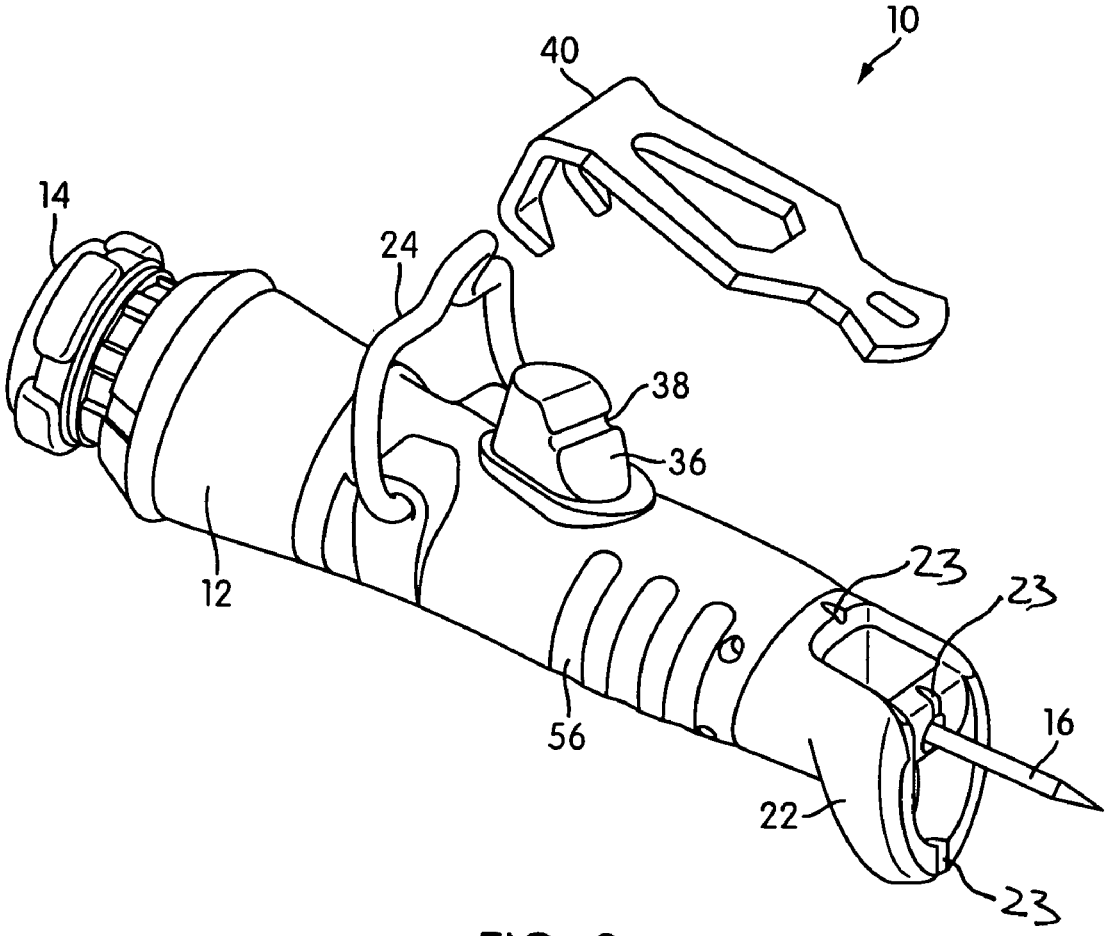
FIG. 2 is a perspective view of a line anchor and line hook in accordance with an embodiment of the present invention.

FIGS. 1 and 2 show a preferred embodiment of the present invention. An exemplary line anchor 10 is provided that generally includes a housing 12, an actuation member 14, an attachment member 16, a nose member 22, and a pivotable hook lock or retainer 24. The attachment member 16, shown here as a pin, is selectively positionable at any of a plurality of distances of extension from the line anchor housing 12, as described below. The line anchor 10 of the present invention may be used in conjunction with a line 42, which may be a chalk line or string line for laying out a straight line between two measured points as used in construction, for example, or the line 42 may be any other line suitable for anchoring. The line 42 may have attached an end member, such as a hook 40, that may be placed over shoulders 27 disposed on the housing 12. The hook lock or retainer 24 pivots to snap into a notch 38 on a boss 36 located on the surface of the housing 12 to lock the line end member 40 in place. The line 42 may be guided by the nose member 22 or channels 23 in the nose member 22 to run against the attachment member 16 and close to the workpiece (not shown) for maximum accuracy. The nose member 22 may have an angled workpiece contact surface to act as a lever and assist in prying the anchor 10 from the workpiece during removal. Further features and exemplary embodiments of the present invention will be discussed in more detail below.

Figure 3:
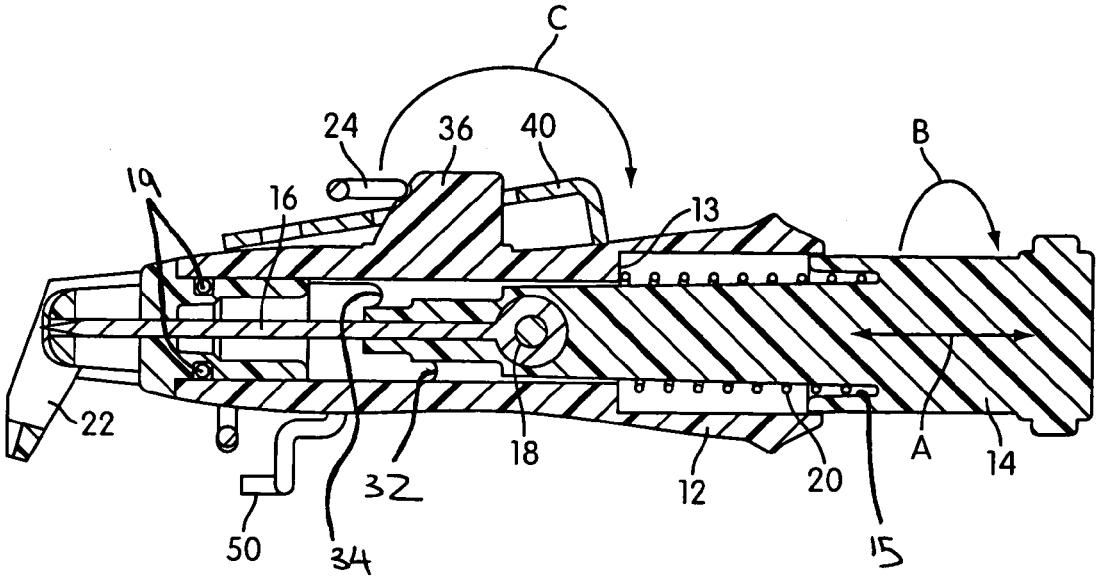
FIG. 3 is a cross-sectional view of a line anchor in accordance with an embodiment of the present invention.

As shown in FIG. 3, the housing 12 may be elongated and configured to slidingly receive an actuation member 14 along its longitudinal axis at one end. The external surface of the housing 12 may include a raised boss 36 having a notch 38 thereon. The external surface of the housing 12 may also include grooves 56 and holes 25 (see FIG. 1). The grooves 56 aid in attaching the line anchor 10 to a conventional line reel 80 (FIG. 8) and the holes 25 (FIG. 4A) are configured to receive a line hook lock 24, described below.

The actuation member 14 has mounted therein an attachment member 16 that is configured to be embedded (or attached) within (or to) a material or workpiece upon which it is desired to lay out a straight line or otherwise anchor a line. In an embodiment, the attachment member may be a pin 16, as shown in the Figures. The pin 16 may be integrally formed with the actuation member 14 or may be separately attached. In an embodiment, the actuation member 14 and the pin 16 are formed of different materials such as plastic and metal, respectively. In such cases it is therefore necessary to attach the actuation member 14 and pin 16 separately or to mold the actuation member 14 over the pin 16. The pin 16 may be fastened to the actuation member 14 by a dowel 18 that passes through an eyelet of the pin 16 and a bore in the actuation member 14, as shown in FIG. 3, or by any other fastening means.

A biasing member, such as a spring 20, may be positioned between a shoulder 13 molded into the interior of the housing 12 and an annular space 15 within the actuation member 14. The spring 20 urges the actuation member 14 in a direction away from the housing 12 (i.e., to the right in FIG. 3).

The line anchor 10 may further include a nose member 22 that is attached to the housing 12 at an attachment end, which is opposite a control end, through which the actuation member 14 is received. Alternatively, the nose member 22 may be integrally formed with the housing 12. The nose member 22 may have an eyelet 21 and may have a surface that forms an obtuse angle with the longitudinal axis of the housing, as is shown in FIG. 1. The angled surface of the nose member 22 is such that it increases leverage and allows a user to more easily pry the line anchor 10 from the material or workpiece during removal. The surface of the nose member 22 may alternatively be angled at a right or acute angle, instead of an obtuse angle, so as to increase leverage. The essence of the prying surface of the nose member 22 is that a portion extends some distance from the longitudinal axis of the line anchor 10 and adjacent to the material or workpiece so that a mechanical advantage is realized.

Figure 4A:
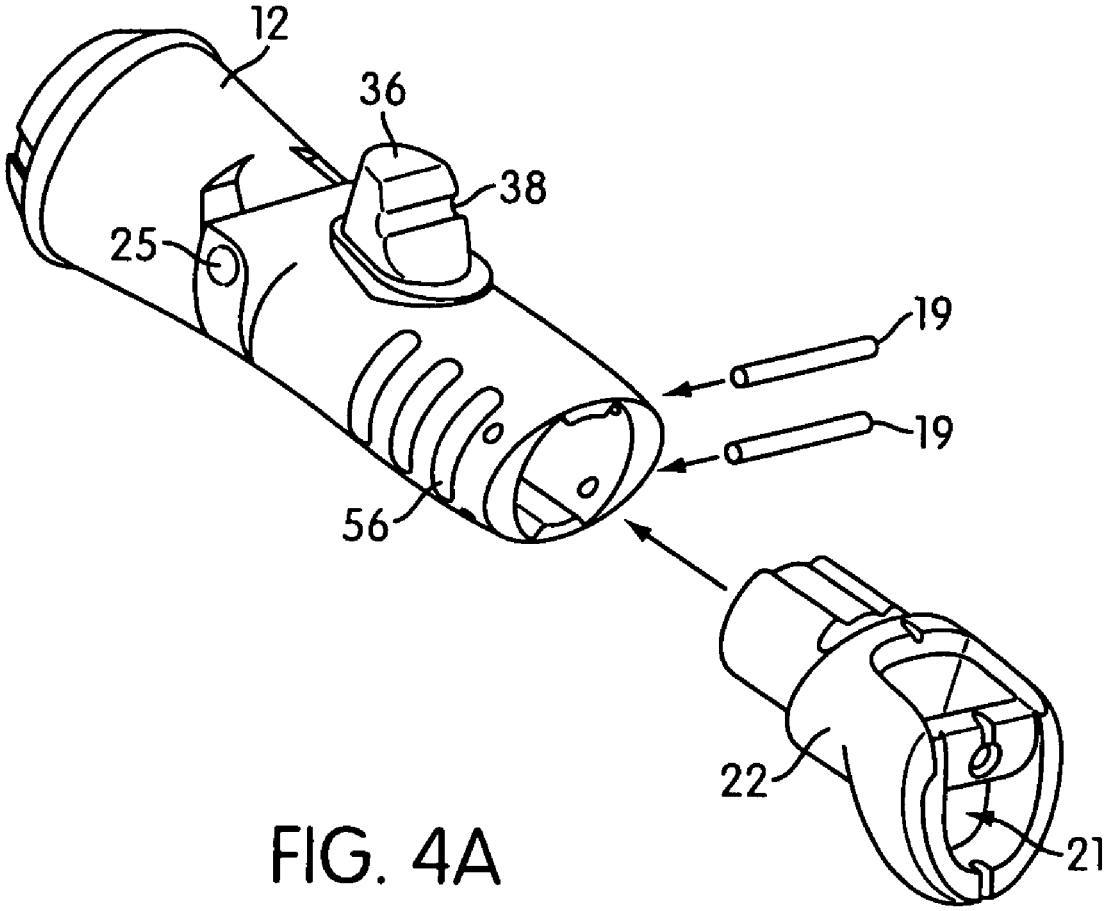
FIGS. 4A, 4B, 4C are exploded views showing assembly steps of a line anchor in accordance with an embodiment of the present invention.
Figure 4B:
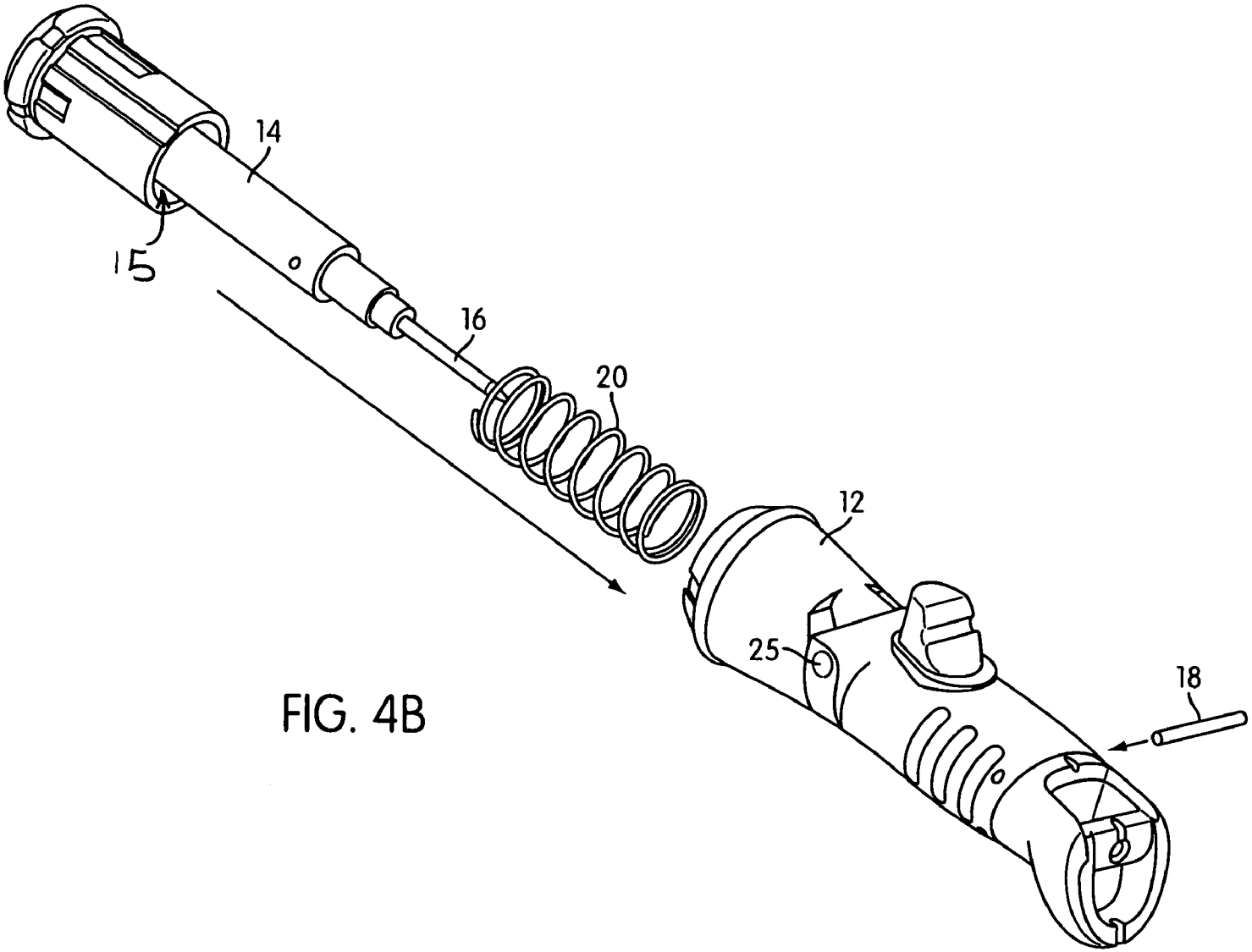
Figure 4C:
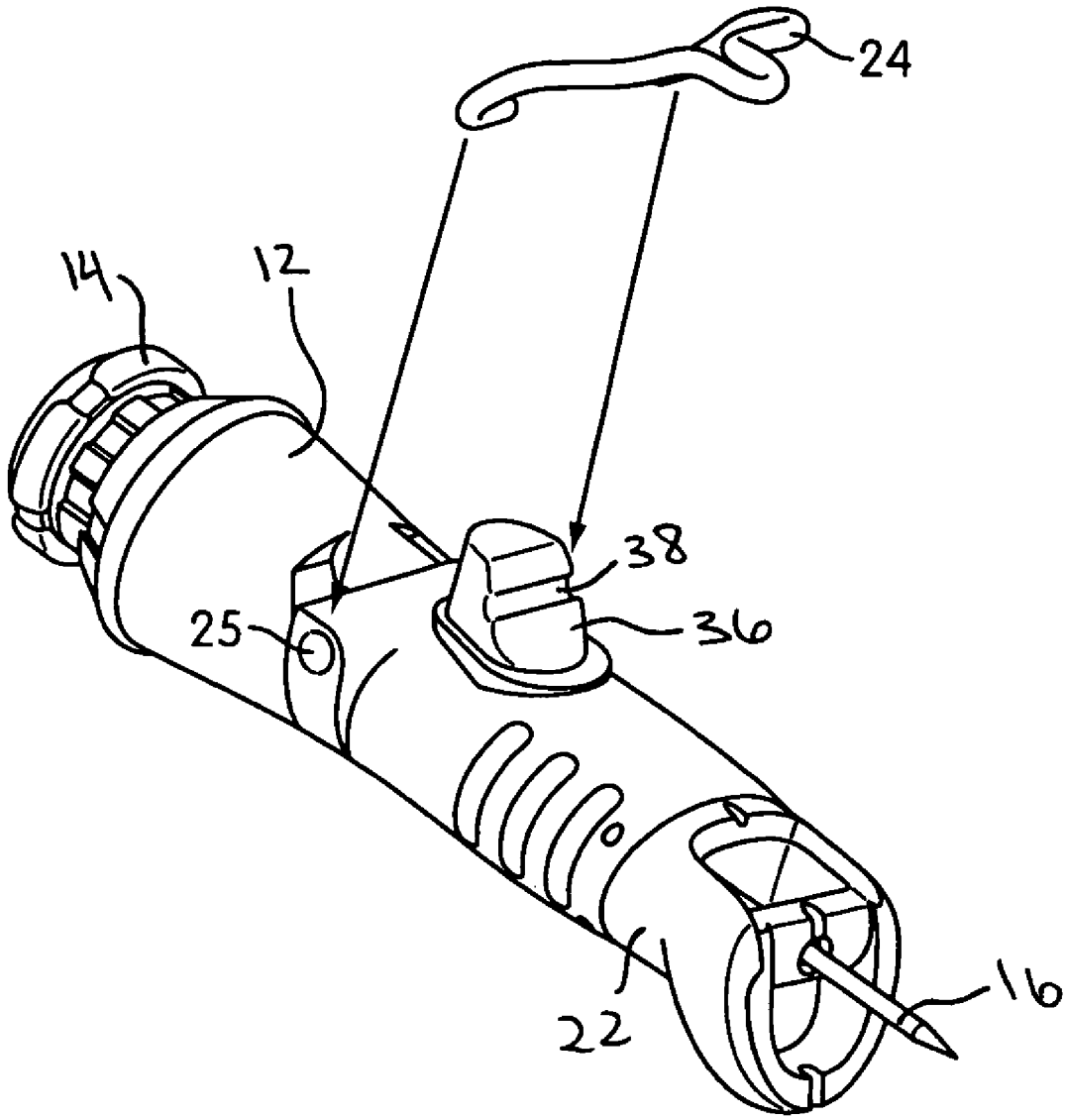

The assembly process is shown in FIGS. 4A-4C. In an initial step, shown in FIG. 4A, the nose member 22 is inserted into a first, attachment, end of the housing 12 and is held in place by one or several pins 19. Next, as shown in FIG. 4B, the spring 20 is inserted into a second, control, end of the housing 12 and is followed by the actuation member 14, which carries the pin 16. The dowel 18 is inserted into a bore 17 (see FIG. 8) in the housing 12 and is received by a bore in the actuation member 14, and optionally an eyelet in the pin 16, to retain the actuation member 14 within the housing 12. Finally, as shown in FIG. 4C, a line hook lock 24 is attached to the housing 12 via holes 25. The hook lock 24 may have two legs that are spread apart to clear the portion of the housing forming the holes 25 and are then released to seat the legs in the holes 25. The hook lock 24 is thereby permitted to pivot about an axis passing through the holes 25.

Figure 5:
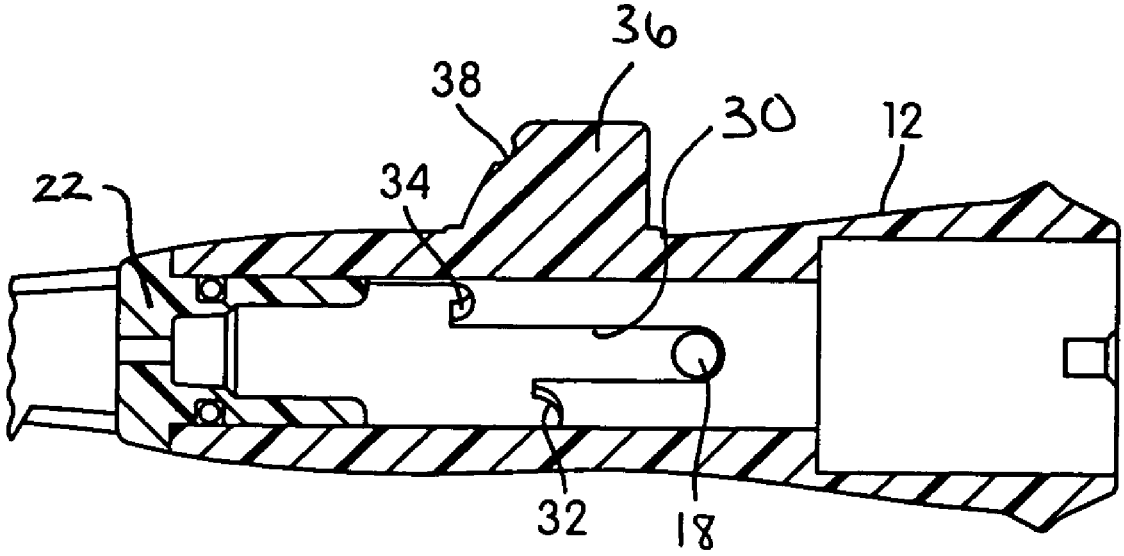
FIG. 5 is a cross-sectional view of the housing of a line anchor in accordance with an embodiment of the present invention.
Figure 6:
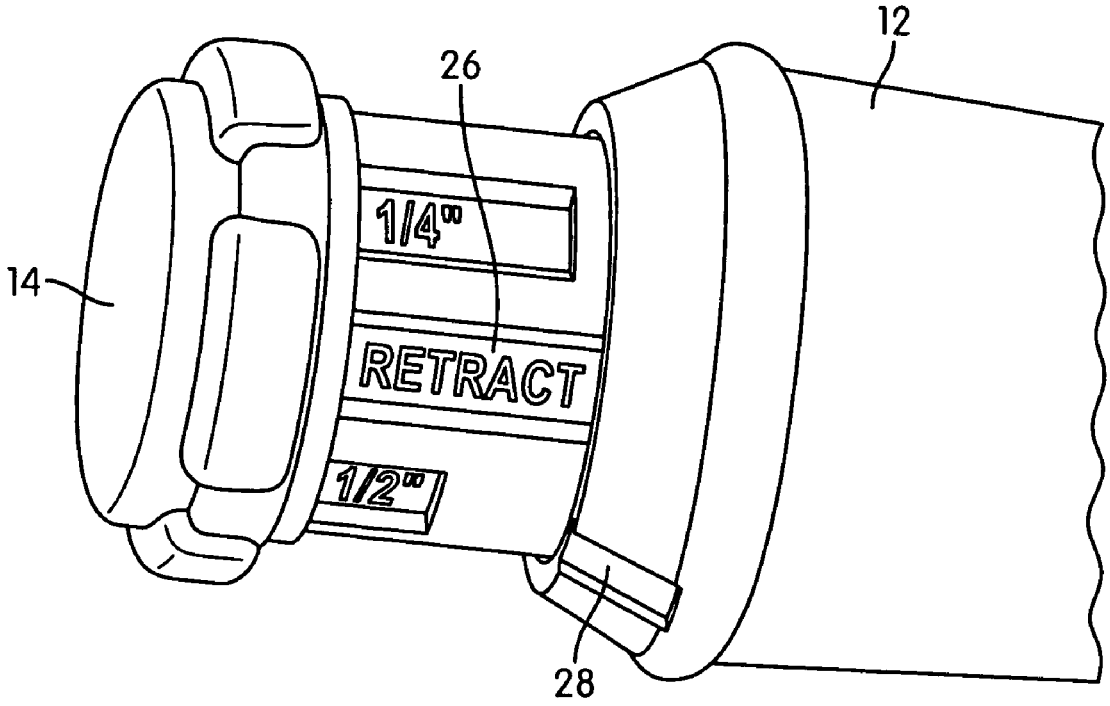
FIG. 6 is a perspective detail view of the end portion of a line anchor in accordance with an embodiment of the present invention.

FIGS. 5 and 6 show the mechanism by which the line anchor 10 allows the pin 16 to extend from the housing 12 at any one of a plurality of predetermined distances. Herein, a distance that the pin 16 extends from the housing 12 is considered to refer to the distance from the tip of the pin 16 to that portion of the housing 12 that is closest to the tip of pin 16 measured substantially along the pin's axis. This distance may also be considered as the amount of pin penetration in a workpiece. The distance is considered to be positive when the tip of the pin 16 is external to the housing 12 and negative when the tip of the pin 16 is within the housing 12. The nose member 22, if present and whether formed integrally with or separately from the rest of the housing 12, is herein considered for descriptive purposes to be an element of the housing 12 such that the above-described distance is measured from the tip of the pin 16 to the nose member 22 where applicable.

As shown in FIG. 5, a first slot 30, a second slot 32, and a third slot 34 may be molded into the interior surface of the housing 12. Each of the slots 30, 32, 34 extends from a forward region (at the attachment end of the housing 12) to a rearward region (at the control end of the housing 12). The first slot 30 extends rearwardly the greatest distance, the second slot 32 extends a lesser distance than the first slot 30, and the third slot 34 extends a lesser distance than the second slot 32. The dowel 18, fixed within a bore in the actuation member 14 (which is operatively connected to the pin 16), has a length and diameter configured to fit within the respective slots 30, 32, 34 and thereby retain the actuation member 14 and pin 16 assembly at various positions along the longitudinal axis of the housing 12. As the spring 20 biases the actuation member 14 in a direction toward the control end of the housing 12, the dowel 18 abuts the end of a slot 30, 32, 34 and holds the actuation member 14 in place, fixing the pin 16 at a predetermined distance.

To change the position of the actuation member 14 and pin 16 assembly, a user may push the exposed portion of the actuation member 14 in the direction of arrow A in FIG. 3 and rotate it in the direction of arrow B in FIG. 3 so that the dowel 18 is aligned with a different slot. When the actuation member 14 is released, the dowel 18 will be urged by the spring 20 toward the end of the slot to thereby fix the pin 16 at a different extension distance. Indicia may be provided on the end of the housing 12 and/or the exposed portion of the actuation member 14, as shown in FIG. 6, to aid in informing the user as to the present location of the pin 16 and directing a user as to which direction the actuation member 14 should be rotated to result in the desired pin extension distance. For example, in FIG. 6 three indicia 26 are displayed on the exposed portion of the actuation member 14: "¼ inch," "RETRACT," and "½ inch." An index mark 28 is provided at the end of the housing 12 to indicate the extension option that represents the current location of the dowel 18 and the distance the pin 16 extends from the housing 12.

While a dowel and slot arrangement is described herein as a mechanism by which the actuation member 14 may be held at various positions along the longitudinal axis of the housing 12, it is appreciated that other suitable systems of retaining the actuation member 14 at different distances may be used. For example, a cam mechanism may be implemented having ramped surfaces molded into the interior surface of the housing 12 that guide a cam follower located on the actuation member 14.

In a first position (shown in FIG. 3), which may be considered a rest or inactive position, the dowel 18 is seated in slot 30, and the pin 16 is maintained within the housing 12 such that it does not extend outwardly from the housing 12. In such a case, the distance of extension may be considered to be zero or have a negative value, corresponding to the distance that the pin 16 is retracted within the housing 12. It may be desired to set the pin 16 entirely within the housing 12 and a distance from the end of the housing 12 so that a slight accidental bump to the exposed portion of the actuation member 14 does not result in the pin 16 emerging from the housing.

A second position may be one in which the dowel 18 is seated in slot 32 and pin 16 extends from the end of the housing 12 at a distance of, for example, 0.25 inches (6.3 mm). This distance may be desired for anchoring a line 42 in relatively hard materials or workpieces that do not require a large amount of pin penetration to maintain the line anchor 10 in position. Such materials may include cement board, particle board, hard board, OSB (oriented strandboard), plywood, wood beams, trim boards, and the like.

In a third position, the dowel 18 is seated in slot 34 and the pin 16 is extended a greater distance from the end of the housing 12, for example 0.5 inches (12.6 mm). This greater distance may be desired for anchoring a line 42 in relatively soft materials or workpieces that may require a greater amount of pin penetration to secure the line anchor 10. Such materials may include gypsum board, asphalt shingles, and the like.

One of ordinary skill in the art will appreciate that, while three predetermined pin positions are depicted in the Figures and described, any number of such positions may be implemented to accommodate and more precisely tailor the distance of pin extension to the particular material or workpiece used. As such, the slots 30, 32, 34 and dowel 18 mechanism described above may be modified to include more slots of varying lengths molded into the interior surface of the housing 12. The amount of slots used is only limited by the space available along the inner circumference of the housing and its length.

The present invention may be used with any type of line, such as chalk lines, string lines, or the like. Conventional line reels 80 are typically provided with an end member, such as a hook 40, to which a line 42 may be secured (as shown in FIGS. 7 and 7A-7D). Moreover, the invention may also be used with free lines or lines without a reel. The line 42 shown in the Figures is not specific to any type of line but is merely representative of the class of lines suitable for use in the present invention.

Where a line 42 has an end member (such as a hook member 40) at its end, the present invention provides a mechanism for attaching the end member to the line anchor 10, as shown in FIG. 7A-7D. In step 1, shown in FIG. 7A, the line hook 40 is hooked or placed against shoulders 27 formed on the exterior surface of the housing 12. In step 2, shown in FIG. 7B, the hook lock or end member retainer 24 is pivoted, as indicated by the arrow (see also arrow C in FIG. 3), over the hook 40 and pressed against the boss 36. A portion of the line hook lock 24 snaps into the notch 38 in the boss 36, thereby locking the line hook 40 in place. To release the line hook 40, the hook lock 24 is simply pulled from the notch 38 and pivoted in the opposite direction, thereby freeing the line hook 40. The hook lock 24 may be formed of spring wire or other suitable material to provide sufficient strength and flexibility.

Figure 7:
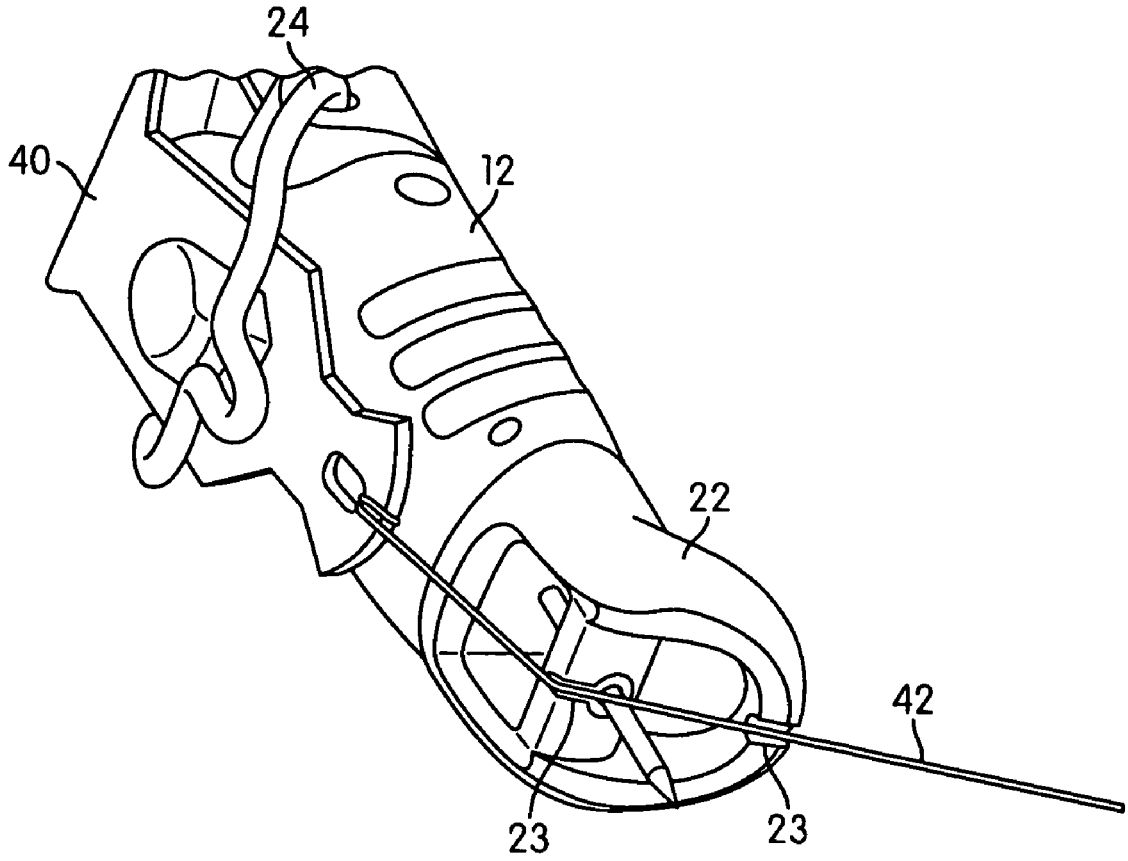
FIG. 7 is a perspective end view of a line anchor and line in accordance with an embodiment of the present invention.
Figure 7A:
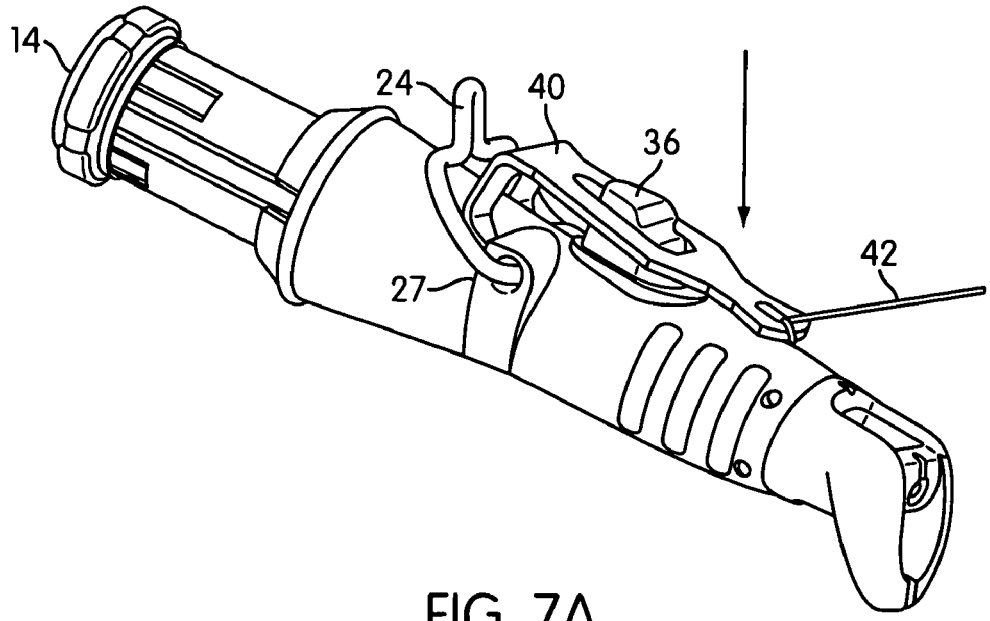
FIGS. 7A-7D show steps for attaching a line to a line anchor in accordance with an embodiment of the present invention.
Figure 7B:
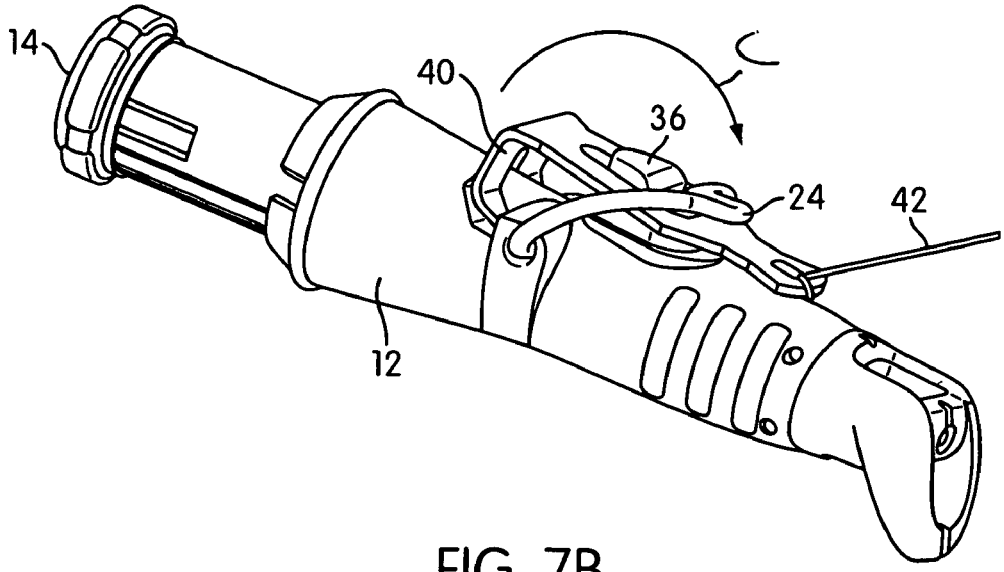
Figure 7C:
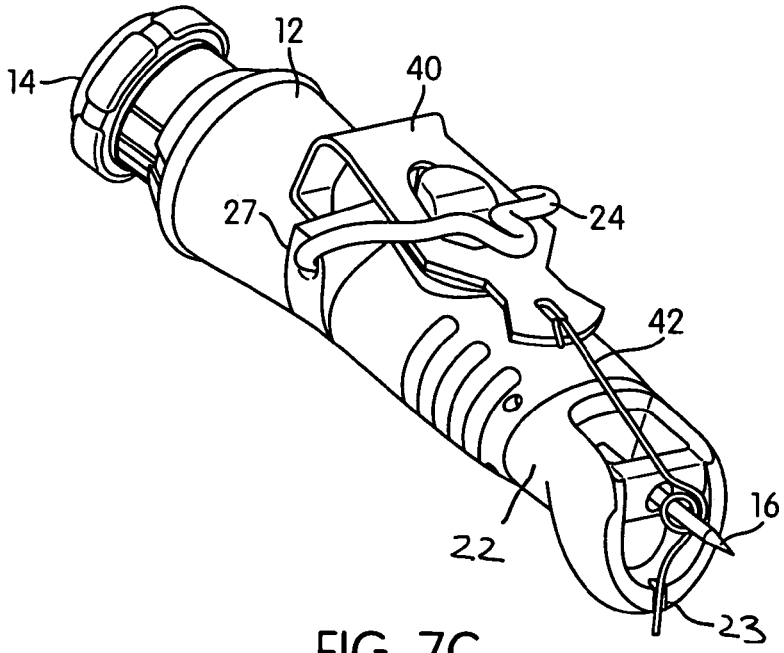

In step 3, shown in FIG. 7C, the pin 16 is extended from the housing 12 to a desired predetermined distance by pushing and rotating the actuation member 14, as described above, and line 42 is wrapped around the pin 16 or allowed to run beside it (as in FIG. 7). The nose member 22 may be provided with guide channels 23 to direct the line 42 away from the line anchor 10 and to allow the nose member 22 to abut the material or workpiece without pinching the line 42. The line anchor 10 may then be driven by hand or with a striking tool into the material or workpiece upon which a straight line is to be laid out.

Figure 7D:
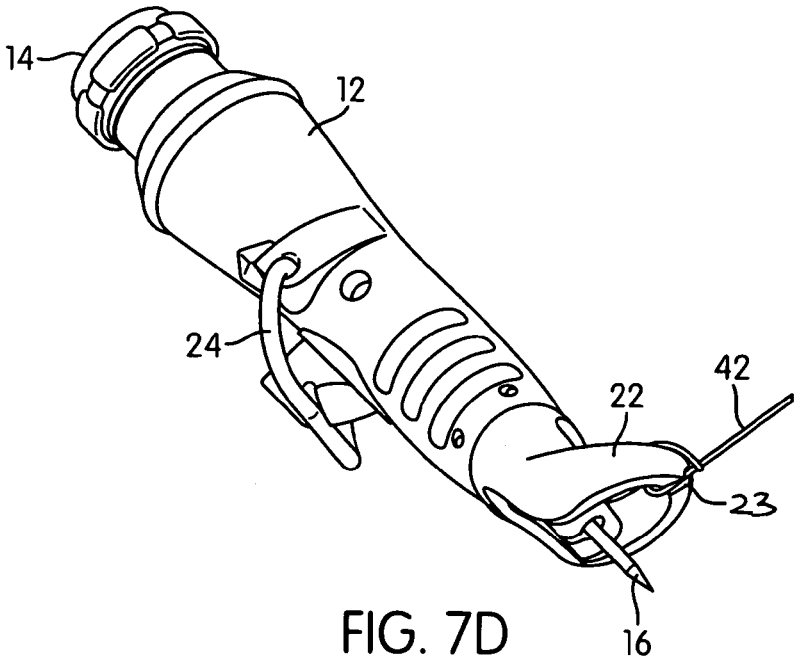

In embodiments in which a free line is used (i.e., where no line hook 40 is provided), the line 42 may instead by tied or otherwise attached directly to the nose member 22, as shown in FIG. 7D. The line 42 may be secured to the nose member 22 at the location of the guide channels 23 so that the line 42 is not pinched between the nose member 22 and the material or workpiece once the line anchor 10 is attached, as shown.

Once the line anchor 10 is securely embedded in the material with the surface of the nose member 22 flush with the material surface, the line 42 is pulled taut and a straight line is laid. In cases where a chalk line reel is used, the line 42 may at this point be snapped to create a chalk line on the material. To remove the line anchor 10, a user may pull the anchor 10 in the same direction that the extended surface of the nose member extends (e.g., in FIG. 1, to the right). The pin 16 may therefore be pried from the material to permit the line anchor 10 to release. After use, the pin 16 may be retracted into the housing 12 by pushing on the exposed portion of the actuation member 14 and rotating it to the "RETRACT" position.

According to an alternative method of using the line anchor 10 of the present invention, the actuation member 14 may be kept in its representative "RETRACTED" position at all times, even during use. In this case the line anchor 10, with the pin 16 in the retracted position, may be held to the material or workpiece upon which a straight line is to be laid out. A user then applies pressure to the exposed portion of the actuation member 14 either manually or with a striking tool to embed the pin 16 in the material until the line anchor 10 is satisfactorily secured. In this case, it is the high friction that results from the embedding of the pin 16 in the material that provides a counterforce to the biasing spring 20, instead of the slots 30, 32, 34, to maintain the pin 16 in the extended position.

It is further noted that this method may also be carried out with the pin 16 being initially extended, as opposed to retracted as described. In this way, a predetermined minimum amount of pin extension is provided while further extension is permitted if necessary or desired. As such, the pin 16 may be extended to any desired distance within the material regardless of the initial degree of exposure from the housing 12 (limited by the length of the pin), thus enabling an extremely adaptable device.

Figure 8:
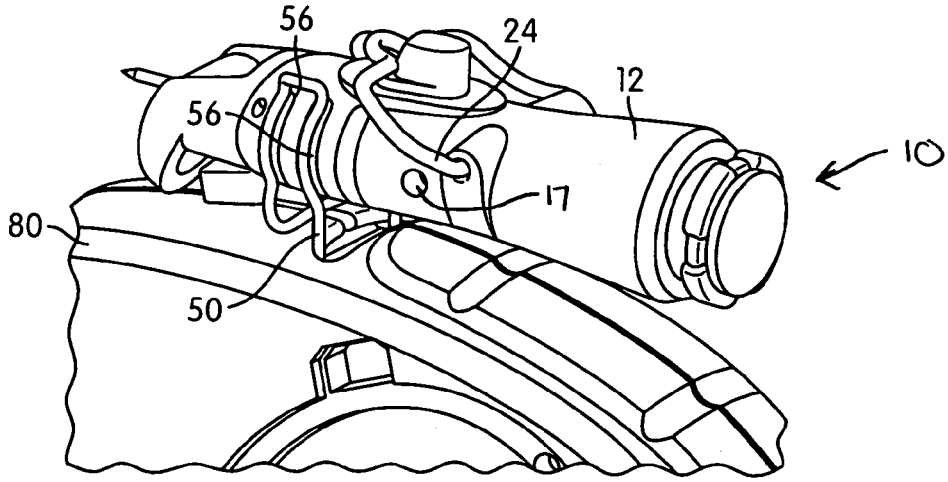
FIG. 8 is a perspective view of a line anchor and line reel in accordance with an embodiment of the present invention.
Figure 9:
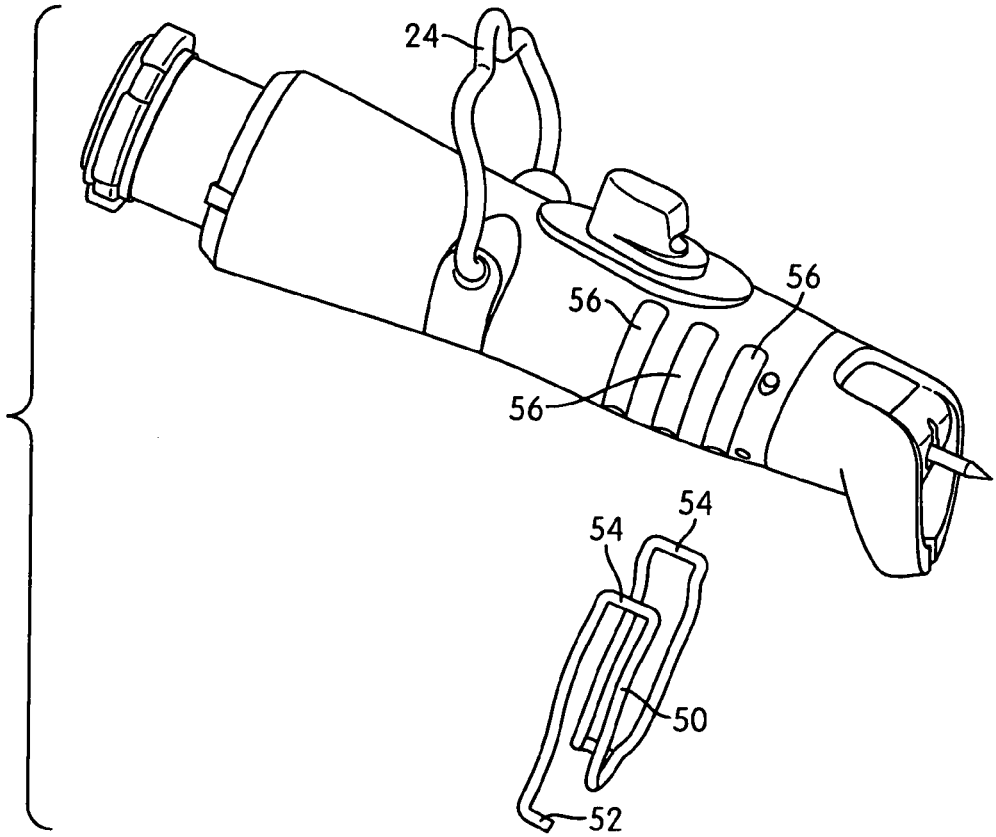
FIG. 9 is a perspective view of a line anchor and spring clip in accordance with an embodiment of the present invention.

According to a further aspect of the present invention, means are provided to conveniently attach the line anchor 10 to a line reel 80, as shown in FIGS. 8-10B. FIG. 8 shows the line anchor 10 in a stored position in relation to a line reel 80 (for safety reasons, a user may instead choose to retract the pin 16 when the line anchor 10 is not in use). As shown in FIG. 9, a spring clip 50 is provided that engages with grooves 56 molded into the outer surface of the housing 12 to secure the line anchor 10.

Figure 10A:
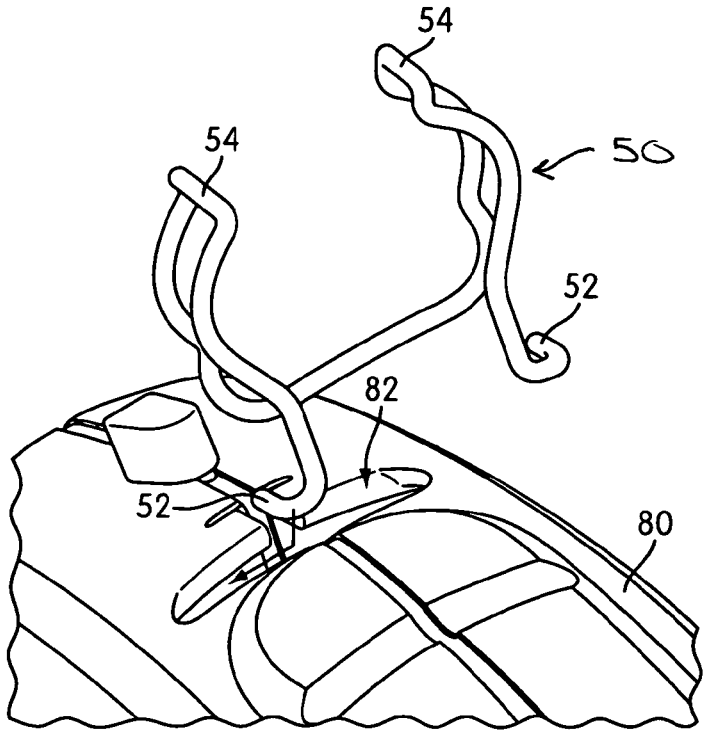
FIGS. 10A and 10B show the steps of attaching a spring clip to a line reel in accordance with an embodiment of the present invention.
Figure 10B:
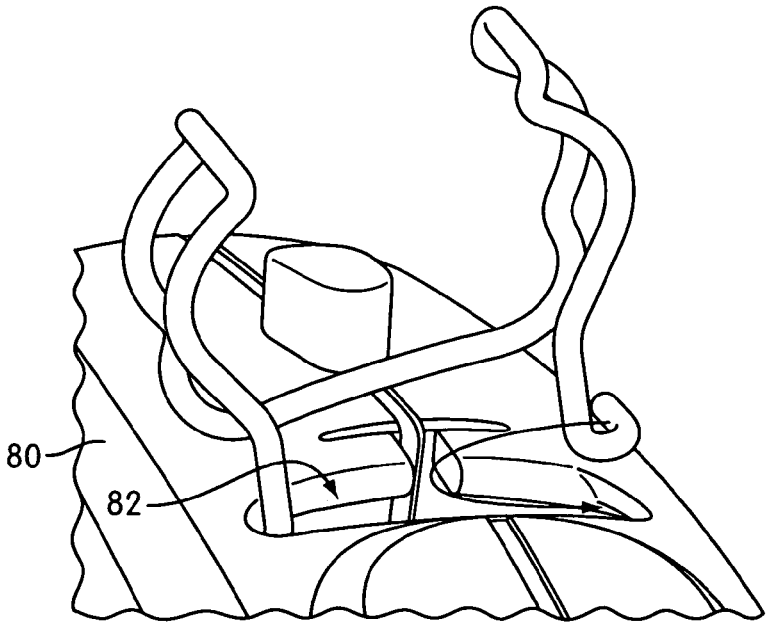

A line reel 80 is provided with a generally T-shaped recess 82 to receive the spring clip 50. The spring clip 50 has legs 52 that are inserted into the recess 82 to hold the clip 50 in place. As shown in FIG. 10A, a first leg 52 of the spring clip 50 is inserted into a short slot of the T-shaped recess 82 and is slid along a long slot of the T-shaped recess 82 until it reaches the end. Then, as shown in FIG. 10B, the spring clip 50 is squeezed and the second leg 52 is inserted into the short slot of the T-shaped recess 82. When the spring clip 50 is released, the second leg 52 slides along the long slot of the T-shaped recess 82 until it reaches the end.

The grooves 56 of the line anchor 10 may then be lined up with arms 54 of the spring clip 50 and pressed into the spring clip 50. The line anchor 10 is thereby held by the spring clip 50 against the housing of the line reel 80 for convenient storage and transportation. To remove the line anchor 10 from the spring clip 50, a user simply pulls it out, applying a force sufficient to overcome the spring force of the clip 50.

While specific embodiments have been described above, it will be appreciated that the invention may be practiced otherwise than as described. The descriptions above are intended to be illustrative and not limiting. Thus it will be apparent to one skilled in the art that modifications may be made to the invention as described without departing from the scope of the claims set out below.

What is claimed is:

1. An anchor for securing a line, comprising:

a housing;

an attachment member for securing the housing to a surface, the attachment member configured to extend from and retract into the housing;

an actuation member movable with respect to the housing, the actuation member operably connected with the attachment member for moving the attachment member;

wherein the actuation member is selectively movable to enable the attachment member to protrude and be retained at one of a plurality of predetermined, discrete distances from the housing, and wherein the attachment member cannot be retained at continuous distances between the discrete distances; and indicia indicating the plurality of predetermined, discrete distances from the housing to which the attachment member is able to protrude and be retained, and wherein the actuation member is selectively movable based on the indicia to select the distance to which the attachment member is able to protrude and be retained.

2. The anchor of claim 1, wherein the attachment member is a pin.

3. The anchor of claim 1, wherein the predetermined distances comprise distances of about 0.25 inches and about 0.5 inches.

4. The anchor of claim 1, wherein the attachment member is fully retractable, so as to be substantially entirely within the housing.

5. The anchor of claim 1, wherein the housing has a longitudinal axis, and wherein the actuation member is configured to rotate about the longitudinal axis of the housing so as to select one of the plurality of predetermined, discrete distances, and wherein the attachment member is configured to protrude at the selected distance by longitudinally moving the actuation member within the housing.

6. The anchor of claim 1, further comprising a spring that biases the attachment member toward a retracted position relative to the housing.

7. The anchor of claim 1, wherein the housing comprises a main portion extending along a longitudinal axis and a nose portion protruding outwardly from an end of the housing from which the attachment member extends, the nose portion comprising a surface forming an angle with respect to the longitudinal axis of the housing, and wherein at least the surface of the nose portion is configured to provide increased leverage to facilitate removal of the attachment member from the surface.

8. The anchor of claim 7, wherein the nose portion includes a channel configured to guide a line.

9. The anchor of claim 1, wherein the housing further comprises grooves on an outer surface thereof, the grooves configured to be received by a clip attached to a line reel.

10. The anchor of claim 1, wherein the housing has a plurality of slots molded into an interior surface, the slots configured to receive a dowel that passes through a bore in the actuation member.

11. The anchor of claim 1, wherein the indicia are provided on the housing and/or the actuation member to indicate a numerical amount representing the distance that the attachment member protrudes from the housing.

12. The anchor of claim 1, wherein both the attachment member and the actuation member are movable linearly along a longitudinal axis.

13. A method for anchoring a line comprising:

determining a distance to selectively retain an attachment member of an anchor based on indicia indicating a plurality of predetermined, discrete distances from an end of a housing to which the attachment member is able to protrude and be retained;

moving the actuation member to selectively retain the attachment member at one of the plurality of predetermined, discrete distances indicated by the indicia from the end of the housing, without being able to retain the attachment member at continuous distances between the discrete distances;

securing the attachment member to a surface; and securing an end of the line to the housing.

14. The method according to claim 13, wherein the indicia are provided on the housing and/or the actuation member to indicate a numerical amount representing the distance that the attachment member protrudes from the housing.

15. An anchor for securing a line, comprising:

a housing;

an attachment member for securing the housing to a surface, the attachment member configured to be moved between a refracted position within the housing and an extended position projecting from the housing, the attachment member being linearly movable along a longitudinal axis;

a spring that biases the attachment member toward the refracted position into the housing;

a manually movable actuation member that is manually movable with respect to the housing without use of a tool, the manually movable actuation member operably connected with the attachment member for moving the attachment member along the longitudinal axis and against the bias of the spring toward the extended position; and indicia indicating the plurality of predetermined, discrete distances from the housing to which the attachment member is able to protrude and be retained, and wherein the actuation member is selectively movable based on the indicia to select the distance to which the attachment member is able to protrude and be retained.

16. The anchor according to claim 15, wherein the indicia are provided on the housing and/or the actuation member to indicate a numerical amount representing the distance that the attachment member protrudes from the housing.

* * * * *